US006105618A

United States Patent [19]

Blaney

[11] Patent Number: 6,105,618

[45] Date of Patent: Aug. 22, 2000

[54] SINK AND BATH PLUGS

[76] Inventor: Trevor Blaney, 58 Anerley Park, London, SE20 8NQ, United Kingdom

[21] Appl. No.: 09/119,859

[22] Filed: Jul. 21, 1998

[51] Int. Cl.[7] ..... F16L 55/10; G01K 11/00

[52] U.S. Cl. ..... 138/89; 138/104; 374/162; 116/216

[58] Field of Search ..... 138/89, 104; 374/162, 374/141, 147; 116/216, 207, DIG. 41

[56] References Cited

U.S. PATENT DOCUMENTS

| | | | |
|---|---|---|---|
| 1,515,222 | 11/1924 | Ruben | 374/146 |
| 2,953,921 | 9/1960 | Muncheryan | 73/363.5 |
| 3,520,189 | 7/1970 | Mann | 374/156 |
| 3,826,221 | 7/1974 | Ross | 116/114 |
| 4,459,046 | 7/1984 | Spirg | 374/161 X |
| 4,738,549 | 4/1988 | Plimpton | 374/161 X |
| 5,144,112 | 9/1992 | Wyatt et al. | 374/162 X |
| 5,265,959 | 11/1993 | Meltzer | 374/162 X |
| 5,302,028 | 4/1994 | Carey | 374/162 X |
| 5,788,375 | 8/1998 | Parker et al. | 374/162 |

*Primary Examiner*—Patrick Brinson
*Attorney, Agent, or Firm*—Cantor Colburn LLP

[57] ABSTRACT

A plug for a bath or sink having a portion the color of which is continuously changeable as the temperature of the portion varies over the range 28 to 44° C. or having a member attached thereto the color of which is continuously changeable as the temperature of the member varies over the range 28 to 44° C.

8 Claims, 1 Drawing Sheet

SINK AND BATH PLUGS

FIELD OF THE INVENTION

This invention relates to sink and bath plugs.

BACKGROUND TO THE INVENTION

A number of injuries occur each year through people stepping into baths which are too hot for safety.

Furthermore when drawing a bath it can be difficult to get the water contained in the bath at the desired temperature without dipping a hand or toe in and then adding hot or cold water as desired.

A general subject of the invention is to provide a plug or similar device adapted to provide an indication of water temperature.

SUMMARY OF THE INVENTION

According to the invention there is provided a plug for a bath or sink having a portion the colour of which is continuously changeable over the range 28 to 44° C. preferably 30 to 42° C. more preferably 32 to 40° C. or a member attached there to the colour of which is continuously changable over the range 28 to 44° C. preferably 30 to 42° C. more preferably 32 to 40° C.

Preferably the portion or member at 40, 42 or 44° C. is yellow, orange or red or another warm colour.

Preferably the portion or member at 28° C. is a cool colour for example blue, green or brown.

Thermally colour changing materials are known. Many such materials are based on liquid crystals and many change colour over a relative narrow range of temperature. While a colour change over a narrow range is desirable for many applications as for example thermometers it is not advantageous in accordance with the invention. It is true that a plug changing temperature at a temperature slightly below that at which tissue damage is likely could prevent injury however it does not allow the user to judge by experience when a particular desired temperature has been reached. In accordance with the invention however the user can rapidly learn by experience the approximate water temperature and thus can adjust the relative proportions of hot and cold water entering the bath to suit the users preference.

Furthermore the visually attractive plug can encourage children into the bath and the reverse colour change on cooling can be used to signal the end of bath time. In particular the colour changing portion could be in a visually appealing pattern which may merge into the background colour at a particular temperature. In these embodiments it may be necessary or desirable to provide several colour changing portions or members. For example a first portion could indicate when the bath is too hot to be safe and a second portion could indicate whether the bath is hotter than a minimum temperature.

In general temperatures below about 28° C. are regarded as too low for comfortable bathing while temperatures greater than 44° C. are regarded as too hot. Somewhat narrower ranges will often be found satisfactory.

For infants the maximum temperature comfortably borne is lower and temperatures in excess of about 38° C. can be dangerous. Accordingly there is no point in having further colour changes beyond about 38° C. or 40° C. for infants.

Bright colours are often easier to see than dark. Little permanent harm is suffered by stepping into a bath too cool while tissue damage can be suffered by stepping into a bath too hot. Accordingly it is preferred that a bright colour be present when the plug is hot. Reds, yellows and oranges are particular associated with danger and heat and thus these colours can. conveniently signal hot water. Greens browns and blue are associated with safety and coolness and it is preferred to use these colours to indicate the lower temperatures.

To avoid wear it may be desirable to mould part of the plug from colour changing material. It may be that at one end of the heat range the colour changing material is transparent and the colour changing may in part be a function of the colour of an underlying substrate.

It is within the scope of the invention for the colour changing material to be carried on a tag attached to the plug.

Those skilled will be able to devise suitable colour changing materials for example some of those marketed by Sieber Heneger.

While the invention has been discussed by reference to baths it will be apparent that the invention is usable in sinks. It may be however that a slightly higher initial and final temperature will be appropriate.

BRIEF DESCRIPTION OF DRAWINGS

Embodiments of the invention will be illustrated by way of non-limiting example by reference to the accompanying drawings in which.

DESCRIPTION OF PREFERRED EMBODIMENTS

Figure 1:
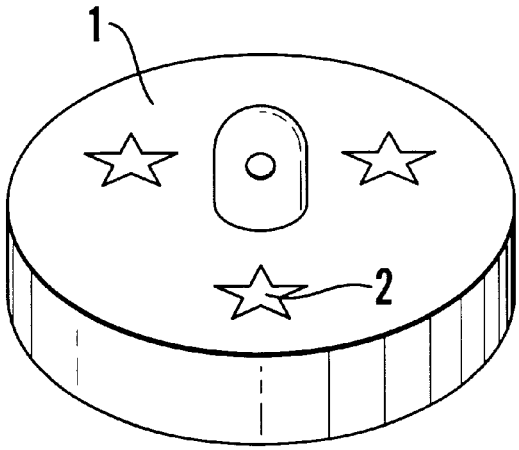
FIG. 1 is a perspective view of a first embodiment and FIG. 2 is a perspective view of a second embodiment.
Figure 2:
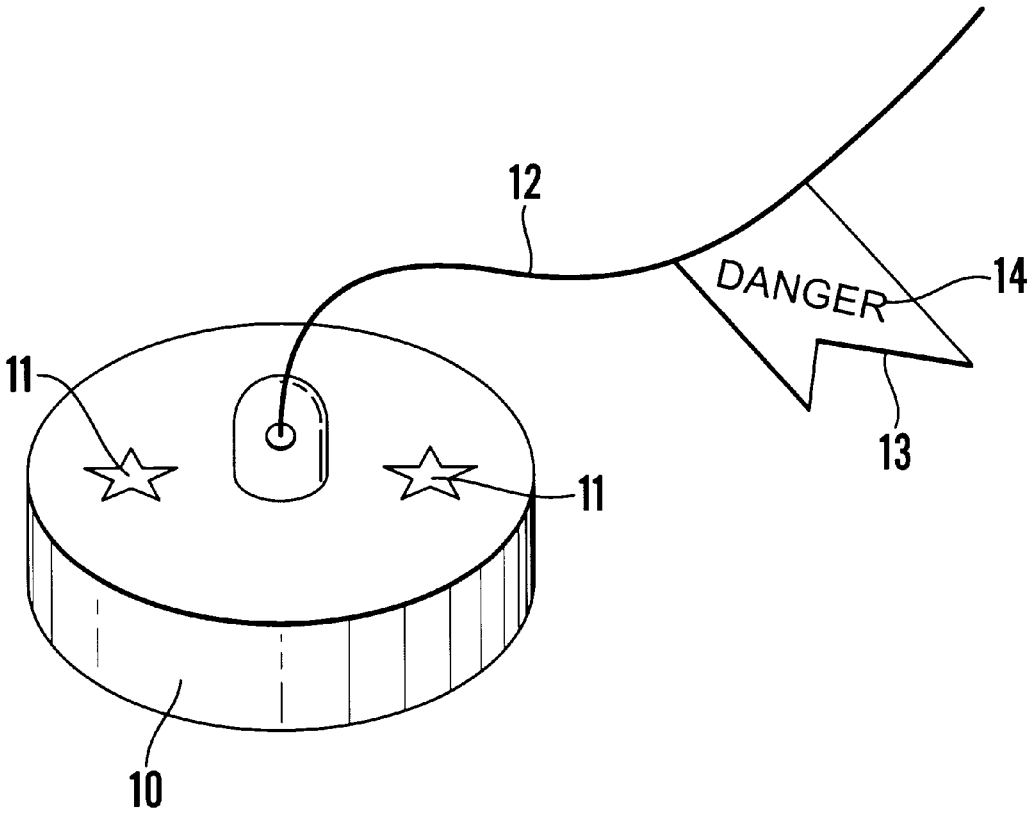

Referring now to the drawings, FIG. 1 illustrates a bath plug 1 provided with a thermochromic portion 2 which changes as the plug is heated. FIG. 2 illustrates a bath plug 10 with a first thermochromic portion 11, a retaining chain 12 and thermochromic member 13 attached thereto. For example thermochromic member 13 turns red when immersed in water dangerously hot while thermochromic portion 11 is a comfort level indicator. In the particular embodiment thermochromic member comprises a flag bearing the blue indicia 14 "DANGER". When the plug is in cool water the flag is blue and the indicia invisble. When the plug is in hot water the flag turns red and the indicia appear.

Those skilled in the art will have no difficulty in devising changes and modifications.

What is claimed is:

1. A plug for a bath or sink for indication of safe water temperature having a portion exhibiting a range of changing colours, the colour of which is continuously changeable over a temperature range and continuously indicative of safe operation within the range of changing temperature as the temperature of the portion varies over the range 28 to 44° C.

2. A plug as claimed in claim 1 wherein the temperature range is 30 to 42° C.

3. A plug as claimed in claim 2 wherein the temperature range is 32 to 40° C.

4. A plug as claimed in claim 1 wherein the portion or member is red at 42° C.

5. A plug as claimed in claim 1 wherein the portion or member is orange at 42° C.

6. A plug as claimed in claim 1 which is at least partially moulded of the colour changing material.

7. A plug for a bath or sink for indication of safe water temperature having a member attached thereto exhibiting a range of changing colours, the colour of which is continuously changeable over a temperature range and continuously indicative of safe operation within the range of changing temperature as the temperature of the member varies over the range 28 to 44° C.

8. A plug for a bath or sink for indication of safe water temperature having a portion exhibiting a range of changing colours, the colour of which is continuously changeable over a temperature range and continuously indicative of safe operation within the range of changing temperature as the temperature of the portion vanes over the range 28 to 44° C. and having a member attached thereto exhibiting a range of changing colours, the colour of which is continuously changeable over a temperature range and continuously indicative of safe operation within the range of changing temperature as the temperature of the member varies over the range 28 to 44° C.

* * * * *